United States Patent [19]

DeHaas et al.

[11] 3,951,734

[45] Apr. 20, 1976

[54] AMMONIA-KETONE PULPING PROCESS

[75] Inventors: Gerrit G. DeHaas; Charles J. Lang, both of Longview, Wash.

[73] Assignee: Weyerhaeuser Company, Tacoma, Wash.

[22] Filed: Oct. 11, 1974

[21] Appl. No.: 514,041

[52] U.S. Cl. ..... 162/72; 162/90

[51] Int. Cl.[2] ..... D21C 3/02; D21C 3/20

[58] Field of Search ..... 162/70, 72, 90

[56] References Cited

UNITED STATES PATENTS

| | | | |
|---|---|---|---|
| 1,975,161 | 10/1934 | Kipper | 162/72 |
| 2,068,151 | 1/1937 | Remler | 162/72 |
| 2,070,585 | 2/1937 | Dreyfus | 162/72 |
| 2,192,202 | 3/1940 | Peterson et al. | 162/72 X |
| 2,538,457 | 1/1951 | Hudson | 162/72 X |

OTHER PUBLICATIONS

Rydholm, *Pulping Processes*, 1965, p. 1156, GP 170.

"Delignification with Ketones and Ammonia", Tappi Manual, Vol. 57, No. 5, 5–1974, pp. 127–130.

*Primary Examiner*—S. Leon Bashore

*Assistant Examiner*—Arthur L. Corbin

[57] ABSTRACT

A method of employing the combination of ammonia and ketones as the cooking chemicals in a digester of a pulping process. This method results in a pulp which has a higher yield than the kraft process yet is characterized by kraft's high strength and fair bleachability. The spent liquor extracts are primarily lignin and contain little cellulose and hemi-cellulose.

6 Claims, No Drawings

AMMONIA-KETONE PULPING PROCESS

BACKGROUND OF THE INVENTION

1. Field of the Invention

This invention relates to a pulping process and more particularly to utilization of the combination of ammonia and various ketones in the cooking liquor of a pulping process.

2. Prior Art

The problem of increasing yield without appreciably decreasing quality of the pulp is a major problem facing the pulp industry today. Yield is the weight percentage of oven-dry cellulosic raw material recovered as pulp at the end of the pulping process.

The cellulosic raw material in wood has three principal constituents: celluloses, hemi-celluloses and lignins. Pulp that is high in quality, having good strength and bleachability, has two of these constituents — cellulose and hemi-cellulose — and little lignins. Therefore, for many products, it is desirable to have a pulp process that will dissolve only lignins from the cellulosic raw material and leave the cellulose and hemi-cellulose unharmed. This process would produce a high yield-high quality pulp.

The most widely used chemical pulping process is the kraft process. Basically, the kraft process is an alkaline cooking process in which sodium hydroxide and sodium sulphide are used to digest cellulosic raw materials. The kraft process, being highly alkaline, dissolves, in addition to the lignin, a significant part of the hemi-cellulose and some of the cellulose by decomposition reactions. This produces a low-yield pulp which is characterized by fibers having good strength and fair bleachability.

This low yield from the kraft process affects the economy of the pulping process in many ways. First, a larger quantity of wood is required to produce a given quantity of pulp. Second, a larger quantity of spent liquor solids have to be processed. Further, the kraft process produces pollutants in the form of odorous sulphur compounds and particulates in the micron and submicron range. The complete elimination of these pollutants is costly and requires the utilization of sophisticated chemical recovery systems. Further, the presence of these sulphur compounds causes increased corrosion of the pulping equipment. Still today, the kraft process produces a pulp which can be used in a wider variety of products than any other.

Other processes have been developed to give products having different characteristics, notably the acid sulphite and neutral sulphite processes. Although the pulp obtained by the acid sulphite process has good bleachability, it does not have the strength of kraft and is also obtained at a relatively low yield.

Neutral sulphite pulp is produced at higher yields. However, the residual lignin content of this pulp is too high for practically all applications except corrugating medium. Neither acid nor neutral sulphite processes pulp resinous woods such as Douglas fir and pines well.

Ammonia base sulphite and bisulphite processes are also used for pulping. U.S. Pat. No. 2,032,437 describes on page 2, lines 1–10, that ammonia gas may be added to the cooking liquor.

U.S. Pat. No. 1,880,047 describes the use of ammoniated water to prepare refined cellulose pulps from crude pulp. U.S. Pat. No. 2,070,585 describes the use of organic solvents, including ketones or mixtures of organic liquids of different polarities, to extract lignocellulosic materials to produce cellulose. U.S. Pat. No. 2,037,001 describes the use for pulping of alcohols which form with water homogeneous mixtures under the hotter conditions for digesting, and which separate into immiscible layers upon cooling after the cooking process is complete. It also describes, on page 2, the use of small quantities of urea to neutralize the acids formed in the reaction. It notes that an ammonia odor is distinctly detectable. A table on page 4 compares the digestion with and without urea. Urea has also been used with sulphite cooks. This is disclosed in U.S. Pat. No. 3,368,935.

SUMMARY OF THE INVENTION

The present invention is directed to a pulping process wherein a cellulosic raw material, such as wood chips, is digested with an aqueous liquid which contains both ammonia and various ketones as cooking chemicals.

The liquor contains 5 to 22%, by weight, of ammonia and 15 to 70%, by weight, of ketones. The mixture of liquor and raw material is reacted in a pulp digester at a temperature of 170° to 220°C for from 10 to 300 minutes. It is then cooled and the reacted cellulosic raw material is separated from the pulping liquor. This process gives bleachable fibers similar in strength to kraft but in yields 10–20% by weight higher based on oven-dried wood.

There is an apparent synergistic effect that occurs when ammonia and various ketones are employed together to digest the pulp raw material. In particular, the pulp is obtained in a yield greater than from the kraft process, yet contains a larger proportion of hemi-cellulose and cellulose and a smaller proportion of lignin than kraft. The ammonia and ketones must act together to dissolve a greater amount of lignin and less of the hemi-cellulose than the kraft process, yet dissolves less total material than the kraft process to obtain a greater yield.

It is possible that ammonia and ketone do not attack the same fractions of lignin material but together they extract a greater amount than either one would. Ammonia is sufficiently alkaline to reduce the size of the lignin molecule and break the bonds between the lignin and the cellulose. The ketones appear to be doing the same thing, although to a lesser degree. The ketones are a good solvent for the resulting organic substances, yet they are soluble in water. A one-phase solution results.

Neither ammonia nor ketone attacks the hemi-cellulose and cellulose material to a great extent. The ammonia is not nearly as strong as caustic, resulting in less shortening of the cellulose and hemi-cellulose chain lengths.

The properties of the high yield pulp obtained from this process allow it to be used in many of the same products as kraft pulp. The pulp can also be bleached to a high brightness. A low residual lignin helps to reduce the quantity of bleaching chemicals required and to lower the pollution associated with bleaching.

The spent liquor of the present process is more suitable for the potential production of chemicals and byproducts than the spent liquor from the kraft process, because it contains more lignin and less cellulose and hemi-cellulose than the waste liquor of kraft pulp. The lignins are suitable for hydrogenation to phenols cresols, ketones and alcohols. The higher lignin content of the dissolved solids causes a higher yield of the above-mentioned hydrogenation products.

The formation of these products is aided by the lesser amount of dissolved cellulose and hemi-cellulose and the absence of sodium and sulfur. The cellulose and hemi-cellulose consume hydrogen. The sodium and sulfur compounds, which form 45% of the dissolved solids from kraft pulping liquor, seriously impair the hydrogenation reactions either as catalyst poisons or by accumulation of non-convertible residues.

In the present process, ammonia and ketones are volatile and can easily be separated during evaporation of the spent liquor. The spent liquor then contains primarily lignin. A more marketable by-product is provided and the problems of disposal of useless by-products are reduced.

The present process also allows the digesting chemicals to be recycled. Ammonia and ketones which are separated by evaporation can be recycled to the digester. Ketones which are products of the hydrogenation process also can be used to supply any make-up chemical that might be needed. This significantly enhances the economical potential of the present process by reducing the cost of chemical makeup.

DETAILED DESCRIPTION OF THE PRESENT INVENTION

The raw material to be used in the present invention can include any cellulosic material that can be pulped. It is preferred to use wood chips as the cellulosic material. Douglas fir and various pines as well as hardwoods would be a common source of these wood chips.

Any commercially available form of ammonia is acceptable. The source of ammonia is not critical to the present invention.

The ketones that can be used in the present invention include acetone, methyl ethyl ketones, methyl isobutyl ketone and cyclohexanone. Also combinations of these various ketones can be employed.

Certain pulping conditions are required in the present invention. The aqueous pulping liquor must contain 5 to 22% by weight concentration of ammonia and 15 to 70% by weight concentrations of ketones. The digestion temperature should be from 170° to 220°C, preferably 190°C to 210°C. The time of cook at these temperatures should be 10 to 300 minutes. The pulping liquor ratio should be 2 to 20 pounds per pound of oven-dried cellulosic material, and preferably 3 to 10 pounds per pound of oven-dried cellulosic material. The term "oven-dried cellulosic material" is a well-known term in the pulp and paper industry referring to cellulosic material which contains no moisture. Thus the pulping liquor ratio must be calculated as to include any water initially present in the cellulosic raw material.

Table 1 shows the effect of ammonia and ketones used together in the present invention. There are no data showing acetone or other ketones used individually because they did not remove the components in alder or conifers sufficiently to be measured. The purpose of the tests shown in these tables was to obtain a high yield with a minimum of residual lignin in the pulp. This was measured by the factor: yield over residual lignin. The higher the factor, the better the ratio of cellulose and hemi-cellulose preserved in the pulp to undissolved lignin. The pulping conditions for all the examples in these tables were as shown and within the limitations set forth for the present invention. Unless otherwise stated, all parts and percentages are on a weight basis.

The woods involved are Alder, Southern Pine, Lodgepole Pine, Douglas Fir and Ponderosa Pine.

Cooks 15, 19, 22 and 23 were 2-stage cooks, and each stage of the cook is denoted in the table. Each of the control Kraft cooks for Douglas Fir was a composite of two separate cooks. These are also denoted.

Table 1

Yield and Delignification

| Cook No. | Wood | Pulping Reagents | Ammonia in Liquor % | Solvent (Ketone or Alcohol) in Liquor % | Liquor/ Wood Ratio | Cook. Time to Temp. (Min.) | Cook. Temp. °C | Cook. Time at Temp. (Min.) | Pulp Yield % | Resid. Lignin | Pulp Yield/ Resid. Lignin Ratio |
|---|---|---|---|---|---|---|---|---|---|---|---|
| 1 | Alder | Ethanol | * | 50 | 5.0 | 30 | 185 | 45 | 73.0 | 24.7 | 3.0 |
| 2 | Alder | Ammonia | 26.3 | * | 6.0 | 27 | 185 | 15 | 73.5 | 21.5 | 3.4 |
| 3 | Alder | Ammonia-Ethanol | 26.6 | 36.7 | 6.8 | 30 | 185 | 45 | 75.8 | 20.1 | 3.8 |
| 4 | Alder | Ammonia-Acetone | 20.3 | 20 | 5.0 | 30 | 185 | 90 | 76.5 | 16.1 | 4.8 |
| 5 | So. Pine | Kraft | * | * | 5.0 | 105 | 170 | 50 | 54.4 | 13.7 | 4.0 |
| 6 | So. Pine | Kraft | * | * | 5.0 | 100 | 166 | 30 | 62.9 | 20.4 | 3.1 |
| 7 | So. Pine | Ammonia-Acetone | 19.2 | 20 | 7.0 | 32 | 210 | 150 | 62.6 | 12.0 | 5.2 |
| 8 | Lodge. Pine | Kraft | * | * | 4.5 | 65 | 168 | 60 | 51.6 | 12.2 | 4.2 |
| 9 | Lodge. Pine | Ammonia-Acetone | 18.0 | 30 | 7.4 | 40 | 210 | 100 | 66.7 | 9.7 | 6.9 |
| 10 | Lodge. Pine | Ammonia-Acetone | 18.0 | 30 | 7.5 | 35 | 210 | 150 | 60.2 | 10.0 | 6.0 |
| 11 | Lodge. Pine | Ammonia-Acetone | 14.3 | 30 | 7.5 | 30 | 200 | 150 | 69.9 | 14.3 | 4.9 |
| 12 | Lodge. Pine | Ammonia-MEK | 18.2 | 30 | 7.0 | 30 | 210 | 150 | 60.9 | 8.0 | 7.6 |
| 13 | Lodge. Pine | Ammonia-MEK | 18.2 | 30 | 7.0 | 30 | 200 | 150 | 67.4 | 11.6 | 5.8 |
| 14a | Doug. Fir | Kraft | * | * | 5.0 | 95 | 164 | 50 | 54.4 | — | — |
| 14b | Doug. Fir | Kraft | * | * | 5.0 | 95 | 164 | 55 | 53.15 | — | — |
| 14 Av. | — | — | — | — | — | — | — | — | 53.8 | 16.6 | 3.2 |
| 15a | Doug. Fir | Kraft | * | * | 5.0 | 105 | 172 | 60 | 48.2 | — | — |
| 15b | Doug. Fir | Kraft | * | * | 5.0 | 105 | 172 | 60 | 48.15 | — | — |
| 15 Av. | — | — | — | — | — | — | — | — | 48.2 | 8.6 | 5.6 |
| 16 | Doug. Fir | Ammonia-Acetone | 18.2 | 30 | 7.0 | 30 | 210 | 150 | 64.3 | 10.5 | 6.1 |
| 17 | Doug. Fir | Ammonia-Acetone | 18.2 | 30 | 7.0 | 30 | 200 | 150 | 75.2 | 12.5 | 6.0 |
| 18(1) | Doug. Fir | Ammonia-CH** | 18.2 | 30 | 7.0 | 30 | 205 | 120 | — | — | — |
| 18(2) | Doug. Fir | Ammonia-CH** | 19.8 | 23.7 | 4.6 | 30 | 205 | 150 | 56.1 | 3.9 | 14.4 |
| 19(1) | Doug. Fir | Ammonia-CH** | 18.2 | 30 | 7.0 | 45 | 220 | 15 | — | — | — |
| 19(2) | Doug. Fir | Ammonia-CH** | — | — | — | 15 | 175 | 180 | 61.4 | 10.2 | 6.0 |
| 20 | Doug. Fir | Ammonia-CH** | 18.2 | 30 | 7.0 | 30 | 210 | 150 | 57.3 | 6.0 | 9.6 |
| 21 | Doug. Fir | Ammonia-CH** | 18.2 | 30 | 7.0 | 30 | 190 | 150 | 66.5 | 16.2 | 4.1 |
| 22(1) | Doug. Fir | Ammonia-CH** | 18.2 | 30 | 7.0 | 30 | 190 | 120 | — | — | — |
| 22(2) | Doug. Fir | Ammonia-CH** | 18.0 | 30 | 5.0 | 30 | 190 | 150 | 64.4 | 11.4 | 5.6 |
| 23(1) | Doug. Fir | Ammonia-MEK** | 18.2 | 30 | 7.0 | 30 | 210 | 30 | — | — | — |
| 23(2) | Doug. Fir | Ammonia-MEK** | 18.0 | 30 | 5.0 | 30 | 210 | 30 | 63.2 | 12.8 | 4.9 |

Table 1-continued

Yield and Delignification

| Cook No. | Wood | Pulping Reagents | Ammonia in Liquor % | Solvent (Ketone or Alcohol) in Liquor % | Liquor/ Wood Ratio | Cook. Time to Temp. (Min.) | Cook. Temp. °C | Cook. Time at Temp. (Min.) | Pulp Yield % | Resid. Lignin | Pulp Yield/ Resid. Lignin Ratio |
|---|---|---|---|---|---|---|---|---|---|---|---|
| 24 | Doug. Fir | Ammonia-CH-MEK** | 18.2 | CH 15.2 MEK 14.9 | 7.0 | 30 | 200 | 120 | 74.7 | 12.5 | 6.0 |
| 25 | Doug. Fir | Ammonia-CH-MEK** | 18.2 | CH 15.2 MEK 14.9 | 7.0 | 30 | 210 | 120 | 60.7 | 7.7 | 7.9 |
| 26 | Pond. Pine | Kraft | * | * | 5.0 | 105 | 170 | 60 | 52.7 | 11.3 | 4.7 |
| 27 | Pond. Pine | Kraft | * | * | 5.0 | 110 | 172 | 60 | 49.3 | 8.2 | 6.0 |
| 28 | Pond. Pine | Ammonia-MEK** | 16.2 | 28.4 | 13.1 | 30 | 205 | 120 | 67.2 | 12.4 | 5.4 |
| 29 | Pond. Pine | Ammonia-CH-MEK** | 12.5 | CH 30 MEK 30 | 8.0 | 30 | 180 | 390 | 73.5 | 15.1 | 4.9 |
| 30 | Pond. Pine | Ammonia-CH-MEK** | 14.0 | CH 15 MEK 15 | 8.0 | 30 | 210 | 120 | 59.9 | 8.5 | 7.0 |
| 31 | Pond. Pine | Ammonia-CH-MEK** | 4.0 | CH 29.7 MEK 30.3 | 8.0 | 30 | 210 | 120 | 61.9 | 13.4 | 4.6 |
| 32 | Pond. Pine | Ammonia-CH-MEK** | 12.5 | CH 29.7 MEK 30.3 | 8.0 | 32 | 210 | 120 | 61.7 | 8.6 | 7.2 |
| 33 | Pond. Pine | Ammonia-CH-MEK** | 8.0 | CH 30 MEK 25 | 8.0 | 30 | 210 | 120 | 63.1 | 8.6 | 7.3 |
| 34 | Pond. Pine | Ammonia-CH-MEK** | 11.0 | CH 25 | 16.0 | 40 | 230 | 40 | 58.6 | 7.8 | 7.5 |

*14–16% active alkali on wood, 22% sulfidity
**CH: Cyclohexanone; MEK: Methyl ethyl ketone Note that the factor (yield over residual lignin) is significantly higher in the case of the ammonia/ketone compounds. This data clearly demonstrates considerably less decomposition of the cellulosic fractions during the present pulping operation which results in a substantially higher pulp yield for the same degree of delignification.

Table 2 shows the higher retention of the hemi-cellulose in the pulp fiber using the present process. The amount of hemi-cellulose can be shown by the amount of mannan in the pulp. Here, the mannan was measured by hydrolyzing the pulp and the amount of mannose (simple sugar of mannan) was determined. The table shows a significant increase in the mannose content in the hydrolyzed pulp samples of the present invention. It also shows that this high percentage can be retained during the bleaching operation.

Table 2

Chemical Composition of Pulp From Douglas Fir Delignified With Cyclohexanone & Ammonia

| Type | Yield % | Lignin % | Glucose % | Mannose % | Xylose % | Unknown % |
|---|---|---|---|---|---|---|
| Unbleached | 57.3 | 6.0 | 74.7 | 18.5 | 6.1 | .7 |
| Bleached | 53.3 | 0.2 | 75.0 | 18.6 | 5.9 | .5 |
| Bleached Kraft | 41.0 | 0.2 | 86.0 | 6.3 | 6.3 | 1.4 |

Pulping Conditions

Cyclohexanone, 30%
Ammonia, 18%

Pulping Temp. 210°C
Time to temp. — 30 min.
Time at temp. — 150 min.

Liquor Ratio 7–0
% Liquor based on pulp
% Glucose, mannose, xylose based on total carbohydrates.

Table 3 shows specific embodiments of the present process. Four samples of the pulping of various woods, the yields and the properties of the pulps obtained are given. Tests were carried out in a 5 cubic feet rotary digester equipped with indirect heating. Chips and the pulping liquor were filled in the digester, heated, and kept at the maximum temperature as indicated. After completion of the cook and the cooling of the contents the liquor was separated from the fiber by washing first with additional solvent and then with water.

It should be noted that pressures normally encountered in the present process are higher than conventional pulping processes. Commercially manufactured equipment, however, is available for practice of the present invention.

Table 3

Pulping of Douglas Fir and Various Pine Species

| Wood | Lodgepole Pine | Douglas Fir | Douglas Fir | Ponderosa Pine |
|---|---|---|---|---|
| Pulping Liquor: | | | | |
| Ammonia % | 18.2 | 18.2 | 18.2 | 16.2 |
| Ketone%* | 30.0 MEK | 30.0 MEK | 30.0 CH | 14 MEK/14 CH |
| Water %** | 51.8 | 51.8 | 51.8 | 55.8 |
| Pulping Conditions: | | | | |
| Time to Max. Temp., Min. | 30 | 30 | 30 | 30 |
| Time at Max. Temp., Min. | 150 | 150 | 150 | 120 |
| Maximum Temperature °C | 200 | 210 | 210 | 205 |
| Liquor Ratio | 7.0 | 7.0 | 7.0 | 13.1 |
| Yield on O. D. Wood % | 67.4 | 60.2 | 57.3 | 67.0 |
| Residual Lignin in Pulp % | 11.6 | 9.0 | 6.0 | 11.1 |
| Factor | 5.8 | 6.7 | 9.6 | 6.0 |
| Pulp Properties: | | | | |
| Freeness (C.S.F.) | 566 | 550 | 550 | 570 |
| Density G/CC | 0.69 | 0.68 | 0.70 | 0.75 |
| Mullen PSI/25 Lb. | 103 | 86 | 73 | 103 |
| Tensile Lb/In. | 54 | 47 | 40 | 53 |
| Stretch % | 3.2 | 2.6 | 2.2 | 3.1 |
| Tear Factor | 4.6 | 6.9 | 5.2 | 4.6 |
| Fold | 436 | 455 | 190 | 524 |
| Brightness % | 14.9 | 9.6 | 15.7 | 16.9 |
| Rupture Energy ERG/G | 149 | 106 | 79 | 154 |

*CH is cyclohexanone, MEK is methyl ethyl ketone.
**Includes moisture in the wood.

The pulp properties were obtained by forming a linerboard sheet at 26 lb./sq. ft. (air dried basis) and measured according to the appropriate TAPPI Standard Methods. These properties obtained in Table 3 are similar to those obtained by the kraft process, but the yields are about 10–20% more than normally expected with the kraft process. The data show that a high quality product and improved yield is produced by the present invention through the synergistic effect of ammonia and various ketones. It should be noted that the various mixtures of ketones are at least as effective delignification agents as the pulping liquors containing only one type of ketone.

What is claimed is:

1. A pulping process comprising the steps of: mixing cellulosic raw materials with an aqueous pulping liquor containing ammonia and one or more ketones; digesting said cellulosic raw material in said liquor at a temperature of 170°C to 220°C and for a time of from 10 to 300 minutes with the ratio of 2 to 20 pounds pulping liquor to 1 pound oven-dried cellulosic raw material, the ammonia concentration and the ketone concentration being from 5 to 22% and 15 to 70% by weight, respectively, of the total liquor; cooling the mixture; separating the pulping liquor from the digested cellulosic raw material.

2. The process of claim 1 wherein the cellulosic raw material is wood chips.

3. The process of claim 1 wherein the ketone is selected from the group consisting of acetone, methyl ethyl ketone, methyl isobutyl ketone, cyclohexanone, and combinations thereof.

4. The process of claim 1 wherein the temperature of the digestion step is from 190°C to 210°C.

5. The process of claim 1 wherein the pulping liquor ratio is from 3 to 10 pounds liquor per 1 pound of oven-dried cellulosic raw material.

6. A pulping process comprising digesting cellulosic raw material with an aqueous pulping liquor containing 10–22 weight % ammonia and 20–60 weight % ketone.

* * * * *